United States Patent [19]

Gazda

[11] Patent Number: 4,487,261

[45] Date of Patent: Dec. 11, 1984

[54] WELL COMPLETION AND TESTING SYSTEM

[75] Inventor: Imre I. Gazda, Saginaw, Tex.

[73] Assignee: Otis Engineering Corporation, Dallas, Tex.

[21] Appl. No.: 290,215

[22] Filed: Aug. 5, 1981

[51] Int. Cl.[3] ..... E21B 49/08

[52] U.S. Cl. ..... 166/264; 166/250; 166/237; 166/242; 166/332; 73/155

[58] Field of Search ..... 166/250, 264, 332, 334, 166/64, 237, 242, 373, 369, 207, 214, 215; 73/155; 285/18, 145

[56] References Cited

U.S. PATENT DOCUMENTS

| | | | |
|---|---|---|---|
| 4,149,593 | 4/1979 | Gazda et al. | 166/237 X |
| 4,274,486 | 6/1981 | Fredd | 166/250 |
| 4,278,130 | 7/1981 | Evans et al. | 166/332 |
| 4,286,661 | 9/1981 | Gazda | 166/316 |
| 4,369,840 | 1/1983 | Szarka et al. | 166/214 |

*Primary Examiner*—Stephen J. Novosad
*Assistant Examiner*—Michael Starinsky
*Attorney, Agent, or Firm*—H. Mathews Garland

[57] ABSTRACT

A well completion and testing system and method. The system includes a tubing string having an integral locking sub and a testing probe assembly for use with well testing instruments and having an equalizing and bypass valve, the probe assembly being releasably lockable in the locking sub and adapted to be manipulated from the surface to open and close the valve for testing a well under both shut in conditions and flowing conditions. The method includes running a tubing string including an integral locking sub into a well bore, running a tool train including well testing instruments connected with a locking probe having an equalizing and bypass valve, releasably locking the probe in the locking sub of the tubing string, and selectively manipulating the probe from the surface to open and close the valve of the probe while taking measurements with the well alternately shut in and flowing.

27 Claims, 7 Drawing Figures

WELL COMPLETION AND TESTING SYSTEM

This invention relates to a well completion and testing system and method, and, more particularly, relates to a system and method for intermittently flowing a well through a tubing string and shutting off the well flow along the tubing string while continuously measuring well conditions through the tubing string.

Petroleum oil and gas formations are frequently tested under both shut in and flowing conditions. Various formation characteristics valuable for future production practices in wells leading to such formations can be determined from such testing procedures. Among the information which is desirably obtained from such tests are the rates at which formation pressures build up under shut in conditions, the rates of pressure reduction under flowing conditions, and related data determinable by testing procedures involving alternately producing and shutting in wells to a formation. Additionally it is desirable to obtain such information as measured in a well at the formation rather than at the wellhead whereby the effects of columns of fluids within the well bores leading to the formation are eliminated. Typical characteristics which may be measured by such procedures are pressure, temperature, fluid flow velocity and the like. It is further desirable that a system and method as in the present invention be adaptable to initial completion of wells so that the well may be tested as desired in the future and also to wells being drilled prior to completion to provide valuable information which may affect ultimate completion of the wells. It is still further desirable that completion systems and methods as in the present invention be designed to provide maximum flow rates and be practiced using a minimum of round trips into a well bore thereby reducing the time and expense required to carry out the tests. Early proposals for systems and methods of measuring well characteristics under static conditions are found in U.S. Pat. Nos. 4,051,897 and 4,134,452 issued to George F. Kingelin and in U.S. Pat. No. 4,149,593 issued to Imre I. Gazda and George F. Kingelin. The systems and methods taught in such patents do not include flowing wells while testing and, further, require one or more extra round trips into a well for equipping the well to carry out the test procedures. Another patent disclosing a similar system and method for intermittently shutting in and flowing a well is U.S. Pat. No. 4,274,485 issued to John V. Fredd. This latter patent shows a system and method, however, which also requires one or more extra round trips into the well bore to properly fit the well for the tests and, additionally, necessarily requires structure within the production tubing of the well which tends to restrict flow through the tubing string. It is thus desirable to measure well characteristics under both static and flowing conditions utilizing a system and method which permits maximum flow rates and which may be carried out with a minimum of round trips into a well. Additionally it is desirable to minimize the different types of operations which must be carried out in a well to effect the desired well testing procedures. For example, prior art systems have required that tubing equipment such as a landing receptacle be run into the tubing string with wireline systems and thereafter the testing be done with electric line systems. Elimination of the initial wireline operation substantially lowers costs and reduces the time required to obtain the desired end re- sults.

It is an object of the present invention to provide new and improved well completion and testing systems.

It is another object of the invention to provide a well completion and testing system in which the well is shut in at a depth at which well characteristics are to be measured eliminating the effects of a column of fluid in the well.

It is another object of the invention to provide well completion and testing systems and methods which permit a well to be tested under both static and flowing conditions.

It is another object of the invention to provide a well system and testing method in which the well may be selectively shut in and flowed by manipulation of the system from the surface end of the well.

It is another object of the invention to provide a well completion and testing system and method in which the tubing string in the well as initially run includes a locking sub for releasably locking and sealing a testing probe run on an electric line thereby eliminating the need for wireline operations and equipment prior to testing.

It is another object of the invention to provide a well completion and testing system and method in which a well may be selectively flowed at maximum flow rates.

It is another object of the invention to provide a well testing probe and locking sub combination which may be utilized with existing well testing systems.

It is another object of the invention to provide a well completion system in which well testing procedures involving alternately shutting in and flowing a well may be carried out by opening and closing an equalizing and bypass valve from the surface by raising and lowering an electric line leading to the testing probe of the system.

In accordance with the invention there is provided a well completion and testing system including a tubing string having an integral locking sub and a testing probe assembly including an equalizing and bypass valve for releasably engaging and sealing with the locking sub for selectively flowing and shutting in the well while providing continuous communication with the tubing string bore below the locking sub for measurements of well conditions under both static and flowing conditions. In accordance with a further aspect of the invention a method for completing and testing a well is provided including the steps of running a string of tubing into the well including an integral locking sub, supporting the tubing string for well fluids flow into the string below the locking sub, running a well testing probe assembly having an equalizing and bypass valve and connected with measuring means into the tubing string and releasably locking the probe assembly with the locking sub, and testing the well under both static and flowing conditions by raising and lowering the line to open and close the bypass valve while making well measurements.

The foregoing objects and advantages and a preferred embodiment of the system and method of the invention will be better understood from the following detailed description taken in conjunction with the accompanying drawings wherein:

FIGS. 1A, 1B and 1C, taken together, form a longitudinal view in section and elevation of a testing probe including an equalizing and bypass valve for use in the system and method of the invention;

Figure 1A:
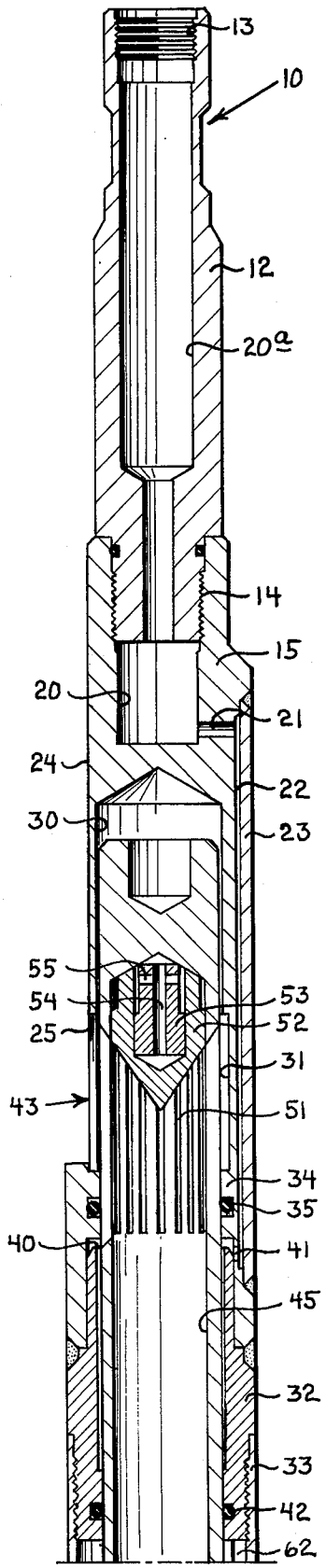
FIG. 1D is an enlarged lower end view of the probe tip shown in FIG. 1C.
Figure 1B:
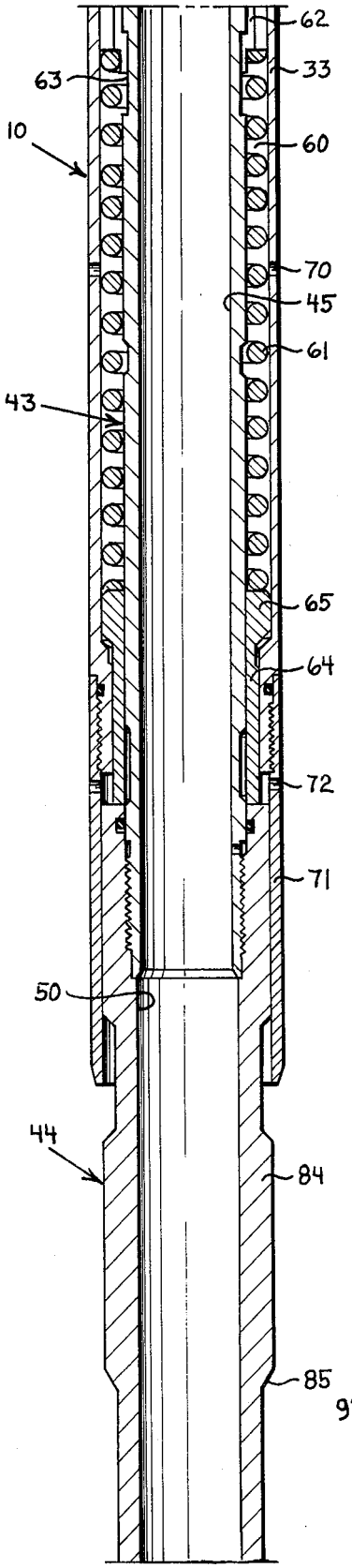
Figure 1C:
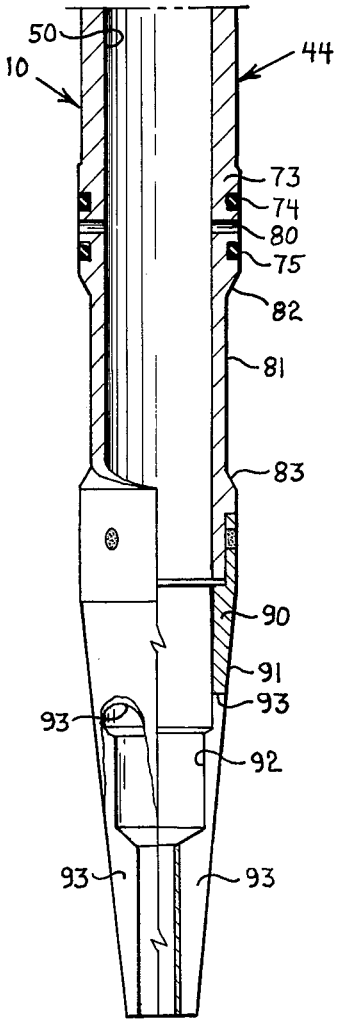
Figure 1D:
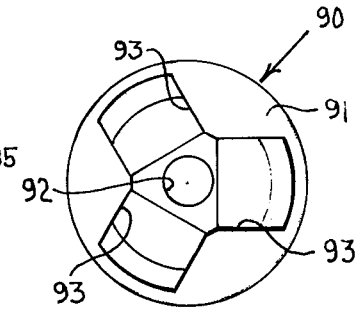
Figure 2:
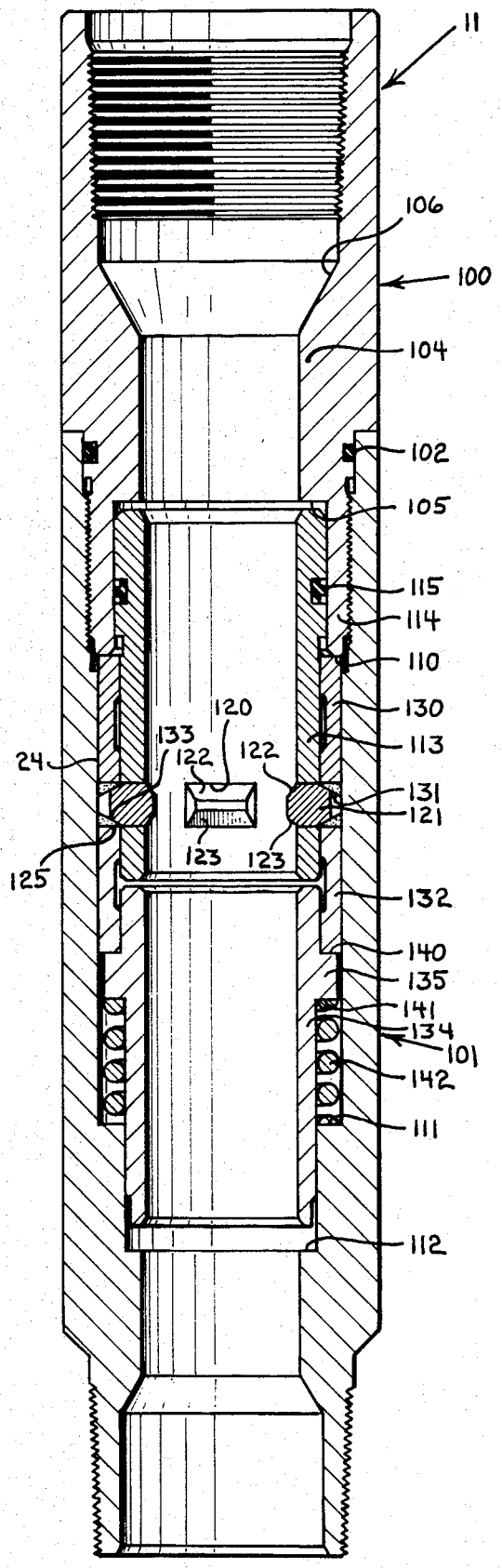
FIG. 2 is a longitudinal view in section of the locking sub employed in the tubing string of the well completion and testing system of the invention.

Referring to the drawings, a probe assembly 10 as illustrated in FIGS. 1A, 1B and 1C and a locking sub 11 as illustrated in FIG. 2, are employed in a well system as illustrated in FIG. 1 of U.S. Pat. No. 4,149,593 providing the well completion and testing system of the present invention. The probe assembly 10 is connectible with the coupling 42 as illustrated in FIG. 1 of U.S. Pat. No. 4,149,593 thereby substituting the probe 10 of the present invention for the equalizing valve and shock absorber 41, adjustable probe 43, and the support assembly 44 of the U.S. Pat. No. 4,149,593. Similarly, the locking sub 11 of the present invention is substituted for the landing nipple 31 connected as an integral part of the tubing string 30 in U.S. Pat. No. 4,149,593 thereby eliminating the lock mandrel 32 and the locking sub 33 of the U.S. Pat. No. 4,149,593. Thus, with the probe assembly 10 of the present invention coupled with and supported from the gauge 34 shown in U.S. Pat. No. 4,149,593 and the locking sub 11 of the present invention connected as an integral part of the tubing string 30 of U.S. Pat. No. 4,149,593, a well is completed or prepared for testing by running the tubing string 30 with the integral locking sub 11 and thereafter the well is tested under both static and flowing conditions by running the probe assembly 10 on the gauge 34 supported from the electric line 35 of the U.S. Pat. No. 4,149,593. The probe assembly 10 is releasably locked in the locking sub 11 and thereafter the probe assembly is manipulated by the electric line to shut in and to flow the well as desired for taking measurements in the well under both static and flowing conditions. Only the initial running of the tubing string with the integral locking sub and thereafter the handling of the probe assembly on the electric line are required for completing the well, or equipping the well for testing, and in carrying out the method of the present invention.

Referring to FIGS. 1A, 1B and 1C, the probe assembly 10 is similar to a probe assembly 41B shown in my pending allowed U.S. application Ser. No. 159,811, filed June 16, 1980, now U.S. Pat. No. 4,286,661. Referring to FIG. 1A, the probe assembly has a tubular adaptor 12 which is internally threaded along an upper end portion at 13 for connection of the probe assembly with the coupling 42 shown in U.S. Pat. No. 4,149,593 and externally threaded along a lower end portion at 14 for connection into the upper end of a crossover head 15. The crossover head has a blind bore 20 opening into the central bore **20*a* of the adaptor 12 for communication from the crossover head upwardly into the measuring means or gauge, not shown, connected with the upper end of the probe assembly. A lateral flow passage 21 connects the bore 20 with a longitudinal slot 22 formed along the crossover head and covered by a longitudinal closure plate 23 welded into the crossover over the slot. The crossover head has longitudinal circumferentially spaced external flats 24 through each of which is formed a window 25 opening through the crossover head into a downwardly opening blind bore 30 of the crossover head. The purpose of the flats 24 is to provide reduced cross sectional area along the crossover head substantially increasing the flow space around the crossover head above the windows 25 for maximum well flow when the bypass valve is open in the probe assembly. In cross section the crossover head 15 along the windows 25 is identical to the cross sectional view FIG. 20 of my U.S. application Ser. No. 159,811, supra. The counterbore 30 of the crossover head is enlarged along a section 31 aligned with the windows 25 of the crossover head for maximum fluid flow to the windows when the bypass valve is open. The lower end portion of the crossover head is connected on a housing coupling section 32 which is threaded into the upper end of a shock absorber spring skirt and housing 33. The crossover head has an internal flange 34 below the windows 25 which carries an internal ring seal 35. The upper end edge of the coupling connection 32 and the internal flange 34 of the crossover head are spaced apart defining an internal annular passage 40 within the crossover head which connects with a port 41 opening into the longitudinal slot 22. Thus, the bore of the crossover head below the ring seal 35 communicates continuously through the annular space 40, the port 41, the longitudinal slot 22, and the passageway 21 into the blind bore 20 from which fluid may communicate through the adaptor bore 20*a* into measuring means connected with the probe. The coupling connection 32 carries an internal annular ring seal 42 spaced from the ring seal 35 to cooperate with the ring seal 35** in providing a closure function for the equalizing and bypass valve of the probe.

As shown in FIGS. 1A and 1B, the crossover head 15, the coupling connection 32, and the shock absorber spring skirt 33 telescope over an equalizing and bypass valve tubular mandrel 43 which threads along a lower end portion into a tubular latching probe 44 shown in FIGS. 1B and 1C. The equalizing and bypass valve mandrel has a longitudinal central bore 45 which connects into a central bore 50 provided in the probe 44. As shown in FIG. 1A the blind bore 30 of the crossover head has a larger diameter than the diameter of the upper end portion of the equalizing and bypass valve mandrel 43 so that as the valve mandrel moves upwardly and downwardly fluid is not trapped in the blind bore 30 which would seriously interfere with the operation of the valve mandrel. The valve mandrel 43 has a plurality of circumferentially spaced longitudinal flow slots 51 which open into the upper end portion of the mandrel bore 45. A conical-shaped flow diverter 52 is mounted within the upper end of the mandrel bore 45 along upper end portions of the flow slots 51 to facilitate nonturbulent flow of well fluids from the mandrel bore 45 outwardly through the slots 51 and the side windows 25 in the crossover head 15. The conical diverter 52 has an upwardly opening blind bore containing a plug 53 which has a central bore 54 and lateral bores 55 opening into the central bore. The use of the conical diverter 52 and the internal plug 53 is to facilitate fabrication of the valve mandrel 43 to provide the conical diverter function in the mandrel bore 45. The machining of the conical diverter 52 as an integral part of the valve mandrel would be extremely difficult. Thus, the diverter 52 and the plug 53 are made as separate parts sized so that the plug 53 readily slides into the blind bore of the diverter 52 and the diverter 52 will easily slide into the upper end of the bore 45 of the mandrel 43. In assembling the diverter 52 in the mandrel the blind bore of the diverter is filled with a suitable liquid cement and the plug 53 is partially inserted into the diverter blind bore. The diverter is then inserted upwardly in the bore 45 of the valve mandrel until it is pressed against the upper end of the bore at which time the plug 53 is forced into the diverter blind bore squeezing the cement outwardly around and over the plug 53 and the diverter 52 so that the spaces within the mandrel bore around both the diverter 52 and the plug 53 are filled with cement. When the cement sets, the diverter is firmly secured within the mandrel in the position shown in FIG. 1A. A suitable cement for securing the diverter within the upper end of the bore of the valve mandrel is an epoxy resin or a suitable bonding agent.

Figure 4:
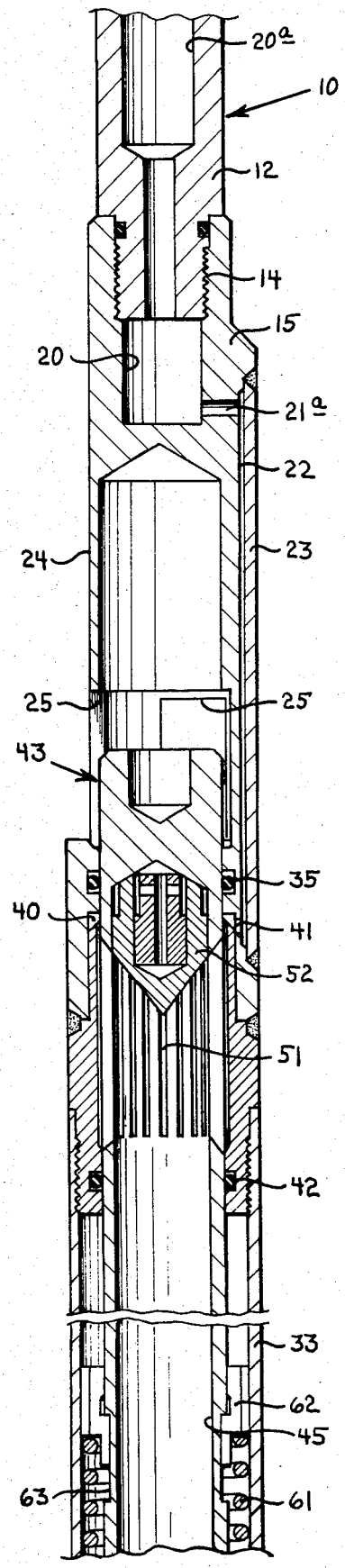
FIG. 4 is a fragmentary longitudinal view in section of the upper end of the probe showing the bypass valve of the probe closed.

The equalizing and bypass slots 51 in the valve mandrel 43 are sized and are sufficient in number to provide maximum flow when the equalizing and bypass valve is open as pictured in FIG. 1A. The lengths of the slots 51 are less than the distance between the ring seals 35 and 42 so that when the valve is closed as illustrated in FIG. 4 the seals are positioned above and below the slots thereby preventing flow through the slots to the side windows 25. The windows 25 also are sized to permit maximum flow from the slots 51 into the tubing string around the probe assembly for flowing a well. The flats 24 are undercut sufficiently to minimize upward drag on the head end of the probe assembly which tends to close the valve when flowing the well. The flow annulus 40 and the side port 41 communicating the bore 45 into the crossover head 15 for measuring well fluid characteristics and the like are in position between the ring seals 35 and 42 and are located such that continuous communication is provided into the bore through the slots 51 whether the valve is opened or closed so that test measurements may be made during flowing of a well and when the well is shut in by closure of the valve.

Referring to FIGS. 1A and 1B, the spring housing 33 is concentrically spaced around the valve mandrel 43 defining an annular space 60 between the members in which a spring 61 is disposed for biasing the equalizing and bypass valve toward the closed position and for providing a shock absorbing function as the probe assembly operates to minimize the transmission of shock forces to the instrumentation used. The upper end of the spring 61 bears against a split stop ring 62 fitted in an external recess 63 around the mandrel 43 limiting the upward movement of the stop ring while allowing limited downward movement of the stop ring so that the ring may move relative to the mandrel 43 compressing the spring in response to a downward shock force. The lower end of the spring 61 bears against the upper end edge of a tubular bumper 64 fitted between the reduced lower end portion of the housing 33 and the valve mandrel 43. The bumper 64 has an enlarged flanged head end 65 which retains the bumper within the housing 33 allowing the bumper to move upwardly in the housing around the mandrel 43 for compressing the spring 61 upwardly in response to upward shock loading. The housing 33 is provided with bleed ports 70 opening into the annular space 60 housing the spring 61. A protective skirt 71 is secured on the lower end of the housing 33 telescoping over the upper end portion of the probe 44 to minimize the collection of trash between the housing 33 and the mandrel 43. A plurality of bleed ports 72 are provided in the skirt 71. The lower end edge of the bumper 64 is engageable with the upper end edge of the probe 44 so that an upward shock force on the probe lifts the bumper compressing the spring 61.

It will be recognized that the crossover head 15, the housing 33, and the skirt 71 fit telescopically over the equalizing and bypass valve mandrel 43 and the upper end portion of the probe 44. The spring 61 biases the crossover head, housing, and skirt and the valve mandrel and probe in opposite directions. The spring biases the crossover head and housing downwardly on the valve mandrel toward the valve open position as shown in FIG. 1A. An upward pull on the upper end of the probe assembly lifts the crossover head, housing, and protective skirt upwardly relative to the valve mandrel compressing the spring 61 and moving the ring seals 35 and 42 upwardly to the positions of FIG. 4 at which the ring seal 35 is above the valve mandrel slots 51 and the ring seal 42 is below the slots shutting off communication from the slots to the side windows 25 and thereby closing the equalizing and bypass valve. Typically the spring 61 is designed and installed compressed to provide a preload of about 180 pounds thus providing a static biasing force tending to open the valve which is added to the weight of the tool train and cable when the probe assembly is in operation tending to hold the valve open. For closure of the valve an upward force then must be applied to the electric cable in amount sufficient to overcome the weight of the cable, the weight of the measuring instruments in the tool train, the upper portions of the probe assembly including the connector 12, the crossover head 15, the housing 33, and the skirt 71 in addition to overcoming the 180-pound preload. Obviously as the electric cable is pulled upwardly the compressing of the spring will increase the force necessary to fully close the valve. The total of such forces necessary to close the valve will be available to reopen the valve.

The latching probe 44 as illustrated in FIGS. 1B, 1C and 1D, has a slightly enlarged seal section 73, FIG. 1C, which carries a pair of spaced external annular ring seals 74 and 75 for sealing with the locking sub 11 as discussed in more detail hereinafter. Side ports 80 are provided in the probe between the seals to prevent any local pressure buildup between the seals around the probe during operation of the probe assembly. The probe 44 also has an external annular locking recess 81 below the seal section between an upper cam surface 82 and the lower surface 83. The probe also has an enlarged central portion 84 terminating in a downwardly and inwardly sloping stop shoulder 85 spaced above the seal section 73. The shoulder 85 limits the downward movement of the probe in the locking sub and is positioned to provide an emergency stroke of the probe in the event it is necessary to jar the probe loose from the locking sub. The probe 44 also includes a tapered lower end tip 90 which is welded on the lower end portion of the main body of the probe. The tapered outer surface 91 of the tip provides a cam surface for easy entry of the probe into the locking sub. The tip has a graduated bore 92. The tip 91 to provide the tapered outer surface of necessity has a restricted bore along the lower end portion of the tapered bore 92. In order to relieve the flow restriction from the bore, a plurality of downwardly opening longitudinal slots 93 are provided in the tip to substantially increase the effective cross sectional area opening through the lower end of the tip for maximizing well fluid flow into the probe. The three slots 93 are cut from the lower end of the tip upwardly into the largest portion of the tapered bore of the tip defining windows opening into the lower portion of the probe bore.

Referring to FIG. 2, the locking sub 11 forms an integral part of a well tubing string such as the string 30 in the system illustrated in U.S. Pat. No. 4,149,593. The locking sub includes a housing defined by a top sub 100 and a bottom sub 101. The top sub is internally threaded along a lower end portion into the upper end portion of the bottom sub. The top sub is internally threaded along an upper end portion providing a box for connection into the well tubing string above the locking sub. Similarly, the bottom sub is externally threaded along a reduced lower end portion providing a pin for connection of the locking sub with a well tubing string section below the locking sub. Ring seal 102 seals the connection between the top sub 100 and the bottom sub 101. The top sub 100 has a reduced bore portion 104 the low end of which defines an internal annular shoulder 105. The lower end edge 110 of the top sub defines a second larger stop shoulder. The bottom sub 101 has a graduated bore including upwardly facing annular stop shoulders 111 and 112. An annular piston and locking lug support sleeve 113 is positioned for longitudinal movement in the bore of the locking sub housing. The upper end portion of the piston 113 telescopes into the threaded lower end portion 114 of the top sub 100. A ring seal 115 is carried by the piston 113 forming a sliding seal with the bore surface of the top sub section 114. The piston 113 has a plurality of circumferentially spaced rectangular windows 120. A locking lug 121 is positioned for radial movement inwardly and outwardly within each of the windows 120. Each of the locking lugs has internal upwardly and downwardly sloping cam surfaces 122 and 123 for operative engagement with the probe 44 to releasably lock the probe in the locking sub. Each of the lugs 121 has upper and lower outside sloping cam surfaces 124 and 125. A tubular cam sleeve 130 is positioned within the bottom sub bore below the shoulder 110 around the piston 113 above the locking lugs 121. An internal annular sloping cam shoulder 131 is formed on the sleeve 130 and which is engageable with the upper external cam surfaces 124 on the locking lugs 121. Similarly, a lower cam sleeve 132 is positioned within the bore of the bottom sub 101 below the lugs 121 and is provided with an upper internal annular cam shoulder 133 which is engageable with the lower external cam surfaces 125 on the lugs 121. The upper and lower sleeves 130 and 132 are slideable in the bore in the bottom sub 101, and the piston 113 is slideable within the sleeves 130 and 132. An operator tube 134 is positioned to slide in the bottom sub 101 below and telescoping upward into the lower sleeve 132. The operator tube has an external annular flange 135 having an upper shoulder 140 engageable with the lower end of the sleeve 132 and a lower shoulder 141 engaged by the upper end of a spring 142. The lower end of the spring 142 engages the bottom sub shoulder surface 111. The spring 142 is installed in a compressed condition so that the spring urges the operator tube upwardly applying an upward force to the lower sleeve 132. The lower sleeve 132 is urged upwardly relative to the upper sleeve 130 which is held against upward movement by the stop shoulder 110. The upward urging of the lower sleeve 132 tends to squeeze the outer portion of the lugs 121 between the cam surface 133 on the upper end of the sleeve 132 and cam surface 131 on the lower end of the sleeve 130. The action of the cam surfaces on the sleeves with the cam surfaces of the outer portions of the locking lugs urges the locking lugs inwardly. An outward force on each of the locking lugs as occurs during the insertion and withdrawal of the probe 44 within the locking lugs forces the lugs outwardly which urges the sleeves 130 and 132 farther apart. Since the sleeve 130 cannot move upwardly, the sleeve 132 is urged downwardly forcing the operator tube 134 downwardly further compressing the spring 142. Thus, the locking lugs 121 are moved outwardly during insertion and release of the probe and are urged inwardly for releasably locking the probe within the locking sub by the spring 142, the operator tube 134, and the sleeve 132. More specific details of the latching and unlatching of the probe are given hereinafter in connection with the detailed operation of the apparatus and method of the invention.

The system and method of the invention may be employed in the permanent completion of a well or may be used as an interim testing procedure to evaluate a formation for obtaining data upon which a decision on continued drilling and/or permanent completion may be made. In the event of use of the system and method as an interim procedure, the system is temporarily installed during the running of the desired tests. In view of the extremely high expense involved in offshore wells, for purposes of making decisions on completion of such offshore wells, it is extremely important to be able to obtain accurate information on the producing formations being drilled.

In accordance with the invention, a well is permanently completed or fitted for testing by connecting the locking sub 11 in a tubing string which is then run into a well bore, supported in the well bore and the wellhead and related equipment is installed as generally illustrated and described in U.S. Pat. No. 4,149,593. As previously discussed in connection with such patent, the locking sub 11 is connected in the tubing string as an integral part of the string in place of the landing nipple 31 of the patent. In accordance with standard industry procedures, one or more well packers may be installed in association with the tubing string to confine and direct production fluids from the desired formation into the tubing string through which they flow to the wellhead at the surface. The probe assembly 10 as illustrated in FIGS. 1A–1D and described herein is then connected in a tool train including the coupler 42 and the gauge 34 supported from the electric line 35 in accordance with U.S. Pat. No. 4,149,593. The probe is lowered in the tubing string by means of the electric line until the probe enters and releasably locks in the locking sub 11. While the probe is being lowered, the spring 61 holds the equalizing and bypass valve of the probe assembly open as illustrated in FIG. 1A. The upper end of the spring engages the split ring 62 coupled on the valve mandrel 43 holding the mandrel at the upper end position illustrated at which the longitudinal slots 51 in the mandrel are vertically aligned above the upper ring seal 35 so that the slots communicate through the side windows 25 in the crossover head 15 of the probe assembly. Thus, as the probe is lowered in the tubing string, part of the fluid in the tubing string passes upwardly into the probe through the windows 93 in the probe tip 91 and along the bore 50 of the probe 44 into the bore 45 of the valve mandrel 43. The fluids move to the upper end of the bore 45 striking the conical-shaped diverter 52 which deflects the fluids outwardly through the slots 51 and windows 25 back into the tubing string above the probe as the probe is lowered. Thus, the fluid in the tubing string does not interfere with the lowering of the probe but rather flows through the probe as the probe is lowered.

Figure 3:
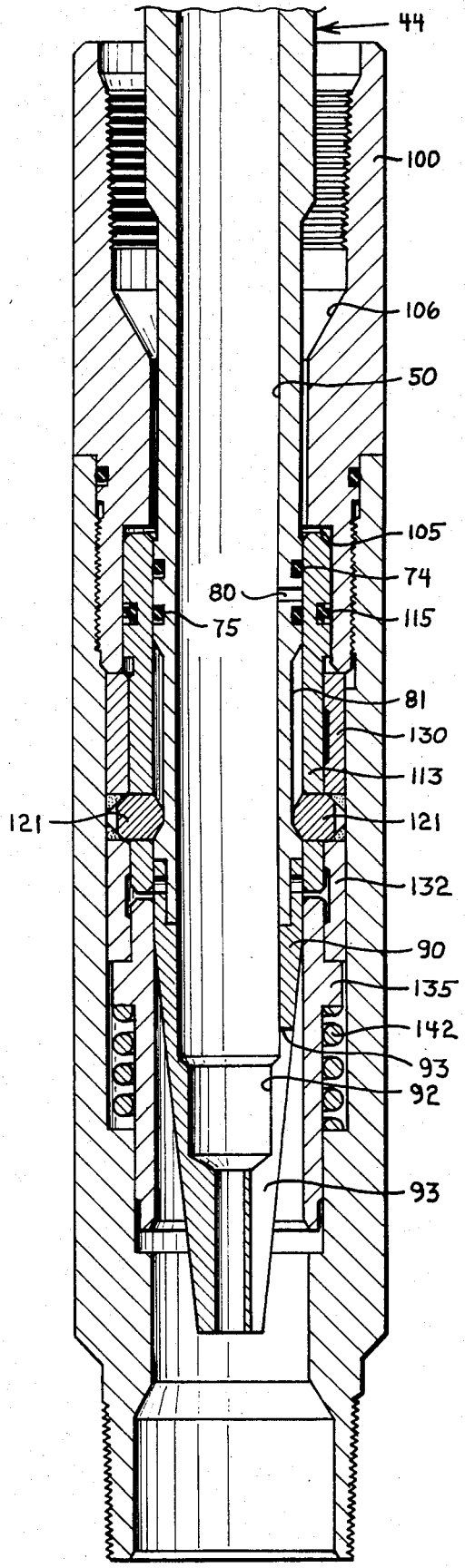
FIG. 3 is a longitudinal view in section showing a lower end portion of the probe releasably locked in the locking sub.

The probe assembly 10 is lowered by the electric line until the probe 44 enters the locking sub 11. The probe tip 90 moves within the locking lugs 121. The sloping surface 91 of the probe tip 90 engages the cam surfaces 122 on the locking lugs and as the probe tip moves downwardly the tip surface 91 forces the lugs radially outwardly in the windows 120 of the piston 113. Because of the low angle of slope of the tip surface 91 relative to the longitudinal axis of the probe, the weight of the probe assembly, the other tools in the tool train, and the electric line is sufficient to expand the lugs 121. The outwardly moving lugs force the lower sleeve 132 downwardly against the operator tube 134 compressing the spring 142. Due to the camming action of the cam surfaces 124 and 125 on the lugs with the cam surfaces 131 and 133 on the sleeves 130 and 132 respectively, the lugs are expanded sufficiently for the probe tip to pass downwardly below the lugs until the probe shoulder 83 is passed the lugs. The force of the spring 142 upwardly against the operator tube 134 lifting the lower sleeve 132 applies a camming action to the lugs urging the lugs radially inwardly into the latching recess 81 on the probe 44 releasably latching the probe in the locking sub 11. FIG. 3 illustrates the probe latched in the locking sub with the locking lugs 121 squeezed into the recess 81 of the probe. The ring seals 74 and 75 on the probe 44 move into sealing relationship in the bore of the piston 113 of the locking sub, thereby confining fluid flow within the tubing string through the locking sub to the bore of the probe. The downward movement of the probe will be arrested by the engagement of the surface 85, FIG. 1B, on the probe 44 with the sloping shoulder surface 106 within the top sub 100 of the locking sub 11. As the probe assembly moves downwardly into the locking sub, any shock forces applied to the probe 44 are absorbed by the spring 61 protecting the instrumentation in the tool train. An upward shock load on the probe tends to lift the probe raising the bumper 64 against the lower end of the spring 61 compressing the spring and absorbing the shock loading. Similarly, of course, as the tool train moves downwardly anything interfering with the downward movement of the probe including engagement in the locking sub stops the downward movement of the probe so that the crossover head 15 with the housing 33 telescopes downwardly moving the split ring 62 downwardly relative to the mandrel 43 compressing spring 61 to absorb the shock. Thus, the spring 61 is capable of absorbing a shock force which either tends to urge the probe and valve mandrel upwardly or the head and housing of the mandrel assembly downwardly.

With the probe assembly 10 releasably locked in the tubing string at the locking sub 11, all upwardly flowing fluid in the well in the tubing string must flow along the bore of the probe to the upper end of the bore where the fluids exit through the slots 51 and the side windows 25 back into the tubing string around the probe assembly and the connected measuring devices and electric line. Further, there is fluid communication in the probe assembly from the bore 45 into the annular space 40 through the port 41 upwardly in the slot 22, back inwardly through the lateral passage 21 into the bore 20 and upwardly through the bore 20*a* of the connector 12 into the measuring devices connected between the probe assembly and the electric line. Due to this fluid communication, pressure measurements are continuously taken while fluid is also flowing through the probe assembly back into the tubing string above the probe assembly and to the surface. Due to the substantially large cross sectional area along the probe assembly and through the locking sub 11, essentially normal well flow may occur while simultaneously measuring well characteristics such as pressure, temperature and the like.

With the equalizing and bypass valve open as illustrated in FIG. 1A, and the well flowing at a high rate, the fluids flowing upwardly and outwardly from the bore 45 of the mandrel 43 through the slots 51 and the side windows 25 tend to lift the crossover head 15 and the connected tool train components upwardly. The provision of the cut-away portions along the flat surfaces 24 above the windows 25 substantially minimizes the lifting effect. Additionally, the diverter 52 deflects the fluid outwardly and upwardly away from the immediately adjacent portions of the crossover head. The weight of the electric cable, the measuring devices, the crossover head, the spring housing 33 and the force in the compressed spring 61 holds the equalizing and bypass valve open.

When it is desired to shut in the well for purposes of determining the formation pressure when the well is not flowing, the rate of buildup of the pressure, and other related well and formation characteristics, the electric line is pulled upwardly lifting the connector 12, the crossover head 15, the spring housing 33, the skirt 71 and the spring bumper 64 compressing the spring 61 and moving the ring seals 35 and 42 upwardly to the positions illustrated in FIG. 4 at which the flow is shut off from the side ports 51 of the equalizing and bypass valve mandrel. The enumerated parts of the probe assembly 10 which are lifted upwardly telescope upwardly on the valve mandrel 43 which is held against upward movement by the probe 44 which is latched in the locking sub 11 by the lugs 121. The probe 44 remains latched while the well is shut in due to closure of the equalizing and bypass valve of the probe assembly. When it is desired to again flow the well, the upward pull on the electric line is relaxed permitting the weight of the line with the measuring tools and the telescoping portions of the probe assembly 10 with the force from the compressed spring 61 to move the equalizing and bypass valve back to the open position of FIG. 1A. The strengths of the spring 142 and the slopes of the cam surfaces on the locking lugs 121 and along the opposite ends of the probe recess 81 are designed to require a greater force to pull the probe out of the locking sub 11 than is required to lift the probe assembly sufficiently to close the equalizing and bypass valve.

Using the system and method of the invention a well may be selectively flowed and shut in for purposes of taking various formation and well characteristic measurements under both flowing conditions and shut in conditions as well as determining rates of change and other factors involved in the transition between flowing and shut in conditions. For example it may be desirable to know the rate of pressure drawdown when going from a shut in to a fully flowing condition. It may also be desirable to know the rate of pressure build up when shutting a well in after fully flowing the well. Measurements may be taken under these various conditions and changes of conditions while the probe assembly 10 remains latched into the locking sub 11. With the probe so latched in the locking sub a change in fluid pressure at the locking sub such as a pressure increase tends to more tightly hold the probe in the locking sub. Thus an increase in pressure along the probe assembly tends to cause the locking sub to more tightly grasp the probe. The pressure differential across the piston 113 as measured by the differential applied over an annular area of the piston defined between the line of sealing of the ring seals 74 and 75 within the piston and the line of sealing of the seal assembly 115 around the piston tends to lift the piston. An upward force on the piston tends to urge the locking lugs 121 upwardly. However, upper sleeve 130 cannot move upwardly and thus an upward force on the lugs 121 cams the lugs more tightly inwardly around the probe 44. Thus a pressure differential increase rather than tending to dislodge the probe causes the probe to be held more tightly by the locking sub.

When the desired measurements have been taken, and the pressure across the tool has been equalized, the probe assembly is released from the locking sub by pulling upwardly on the electric line with a force in excess of that required to close the equalizing and bypass valve. The upward force on the probe assembly urges the probe surface 83 upwardly against the inside lower cam surfaces 123 on the lugs 121. The lugs are urged outwardly between the upper sleeve 130 and the lower sleeve 132. The upper sleeve 130 cannot move upwardly and thus the camming action between the upper outer lug surfaces 124 and the inner surface 131 on the sleeve 130 forces the lugs downwardly as the lugs move outwardly. The piston 113, the lower sleeve 132, and the operator tube 135 move downwardly with the lugs compressing the spring 142. When the lugs are moved outwardly sufficiently for the probe surface 183 to clear the lugs, the probe is released for movement upwardly and withdrawal from the locking sub. Downward movement of the piston 113 tends to prevent any well swabbing which might occur when pulling the probe out of seal relationship within the piston.

In order to prevent blowing the probe assembly up the tubing string when releasing the probe from the locking sub, pressure should be equalized across the probe assembly before pulling upwardly on the electric line sufficiently to disengage the probe from the locking sub. If the well has been shut in for taking measurements prior to removal of the probe assembly, the well should be shut in at the surface and the electric line relaxed sufficiently to permit the equalizing and bypass valve to open until the pressure equalizes across the probe assembly at the locking sub. With the pressure equalized an upward force may be applied to the electric line pulling the probe from the locking sub without any tendency to blow the probe up the tubing string due to a pressure differential.

If the probe becomes stuck several methods are available for release. Fluid pressure in the tubing string around the probe may be increased from the surface, for example, as much as 600 pounds per square inch, sufficiently to urge the piston 113 downwardly camming the locking lugs 121 outwardly from the probe surface 83. The distance on the probe 44 between the surface 85 and the surface 83 is sufficient to provide an emergency stroke of the probe allowing the probe to be jarred upwardly and downwardly for trying to release the probe from the locking lugs. Lastly, conventional wireline fishing equipment and techniques may be used to release and pull the probe from a well.

As soon as the probe is released from the locking sub the spring 61 lifts the equalizing and bypass valve mandrel 43 upwardly returning the valve to the open position so that fluid bypass readily occurs as the tool train including the probe assembly is retrieved from the tubing string of the well.

Special benefits of a well system and method in accordance with the present invention are discussed in some depth in a paper prepared by me with H. L. Cantlon and G. F. Kingelin entitled "Downhole Shut-Off Tool" published in 1979 by the American Institute of Mining Mettalurgical and Petroleum Engineers, Inc., SPE 7809. In accordance with the present invention there is provided a well system including a locking sub forming an integral part of a well tubing string and a probe assembly adapted to be connected with well testing means, releasably locked with the locking sub, and operated while latched in the sub to alternately flow and shut in a well for making measurements during both static and dynamic conditions and during the transitions between such conditions. The method involves the steps of running a locking sub as an integral part of a tubing string into a well as either a part of a permanent completion system or temporarily for testing purposes and thereafter inserting a probe assembly coupled with testing instruments, latching the probe assembly into the locking sub, opening and closing the probe assembly equalizing and bypass valve to flow and shut in the well as desired while taking the desired measurements, and thereafter removing the probe assembly from the locking sub in the tubing string. The use of the integral locking sub in the tubing string eliminates one or more extra round trips into a well and the necessary equipment and personnel for making such trips. Further, the use of the integral locking sub removes prior art apparatus from the tubing string as lock mandrels and the like which limit the bore along the tubing string at the point of locking the probe assembly in the string. Thus, a substantially larger cross sectional area oCf the tubing string is available along the portion in which the probe assembly locks thereby substantially increasing the flow of the well while carrying out the testing procedures.

What is claimed is:

1. A well completion and testing system comprising: a tubing string including an integral tubular locking sub as a section thereof; and a probe assembly adapted to be connected with and supported from well characteristic measuring means and releasably coupled with said locking sub, said probe assembly including an equalizing and bypass valve operable from the surface end of a well while coupled in said locking sub to shut in and to flow a well while providing continuous communication between said measuring means and said well below said locking sub.

2. A well completion and testing system in accordance with claim 1 where said locking sub has a bore therethrough having a cross sectional area substantially equal to the cross sectional area of the tubing string into which said locking sub is connected.

3. A well completion and testing system in accordance with claim 2 where said locking sub has locking dogs engageable with a locking recess on said probe assembly.

4. A well completion and testing system in accordance with claim 3 where said locking sub includes a pressure responsive piston supporting said locking lugs for pressure responsive release of said lugs from said probe assembly.

5. A well completion and testing system in accordance with claim 4 where said locking sub includes means for applying a holding force to said locking lugs responsive to a pressure differential applied across said piston.

6. A well completion and testing system in accordance with claim 5 where said valve in said probe assembly is normally open and is closable by applying an upward force to the upper end of said probe assembly.

7. A well completion and testing system comprising: a tubing string in a well including an integral locking sub having a tubular housing provided with opposite end means for connecting said housing into said tubing string as a section thereof; an annular piston in said housing; a plurality of radially movable locking lugs supported in side windows in said piston; operating sleeve means around said piston in said housing for urging said lugs inwardly to locking positions and permitting said lugs to move outwardly to relase positions; an operator tube engaged with said sleeve means; means biasing said operator tube toward said sleeve means; a probe assembly releasably lockable in said locking sub and having a longitudinal bore; seal means for sealing in said locking sub piston to direct flow through said tubing string and locking sub into said probe bore; and an equalizing and bypass valve for permitting flow from said probe bore into said tubing string above said locking sub at one operating mode and shutting off flow in said string at a second operating mode, said valve being operable between said first and second operating mode while coupled in said locking sub.

8. A well completion and testing system in accordance with claim 7 further including means for connecting said probe with well testing means including flow passage means for communicating said probe bore at both operating modes of said equalizing and bypass valve.

9. A method of testing a well comprising: running a string of tubing including an integral tubular locking sub into said well; supporting said tubing in said well for flow of well fluids into said tubing below said locking sub; running a tool train including a probe assembly into said tubing string until said probe assembly is releasably coupled in said locking sub, said probe assembly having a bore for flowing fluids upwardly from said sub to measuring means above said probe along a first flow path and for bypassing fluids back into said tubing string above said locking sub along a second flow path, and an equalizing and bypass valve for controlling flow along said second flow path; continuously communicating well fluid along said first flow path to said measuring means; and intermittently flowing well fluids along said second flow path through said valve while said probe assembly remains coupled in said locking sub.

10. A method of testing a well in accordance with claim 9 where said probe assembly is manipulated for opening and closing said valve from the surface end of said well.

11. A method of testing a well in accordance with claim 10 wherein the pressure drop in said well fluids as said fluids flow through said probe assembly valve is substantially equal to the pressure drop in said fluids as said fluids flow along said tubing string below said locking sub.

12. A method of testing a well in accordance with claim 11 where said probe assembly is manipulated by pulling up on said assembly to close said valve and releasing said assembly to reopen said valve.

13. A method of testing a well in accordance with any one of claims 9, 10, 11 or 12, including the step of releasing said probe assembly from said locking sub by applying an upward force to the upper portion of said probe assembly greater than the upward force required to close said equalizing and bypass valve.

14. A method of testing a well in accordance with claim 13 including the step of equalizing the pressure across said probe assembly prior to releasing said probe assembly from said locking sub.

15. A method of testing a well in accordance with claim 14 where said tool train is supported from and said probe assembly is manipulated by an electric line.

16. A well completion and testing assembly including well tool landing and locking means forming an integral tubing string section and a removable operating probe releasably connectible in said landing and locking means having means for connection to well fluid measuring means, valve means for fluid flowing and shutting-in fluid flow along a tubing string including said landing and locking means, said valve means being opened and closed by said probe when said probe is landed and locked in said landing and locking means, and flow passage means providing continuous fluid communication through said probe to said measuring means.

17. A well completion and testing assembly in accordance with claim 16 wherein said probe includes a valve for equalizing pressure across said probe.

18. A well completion and testing assembly in accordance with claim 17 wherein said equalizing valve is closed by an upward force applied to said probe and opened responsive to release of said upward force.

19. A well completion and testing assembly in accordance with claim 18 wherein said valve means for flowing and shutting-in flow along said tubing string is closed responsive to an upward force on said probe and opens responsive to release of said upward force.

20. A well completion and testing assembly in accordance with claim 19 including seal means on said probe and a seal surface in said landing and locking means for effecting a seal between said probe and said landing and locking means when said probe is installed in said landing and locking means.

21. A well completion and testing assembly in accordance with claim 20 wherein said valve means is spring biased toward open position.

22. A well completion and testing assembly in accordance with claim 21 wherein said valve means is closed responsive to a first upward force and said operating probe is removed from said landing and locking means responsive to a second greater upward force.

23. A well completion and testing assembly in accordance with claim 22 wherein said operating probe is supported on a wireline extending downwardly in a tubing string of which said integral tubing section is a part thereof.

24. A method of testing a well comprising: running a string of tubing including an integral landing and locking means section into said well; releasably installing a tool train including measuring means and a probe assembly in said landing and locking means section; continuously communicating said measuring means with well fluids in the tubing string from below said landing and locking means section through said probe assembly; and intermittently flowing well fluids through said landing and locking means section responsive to an upward force on said probe assembly.

25. A method of testing a well in accordance with claim 24 wherein the pressure in said well fluids across said probe assembly is equalized prior to flowing said well fluids.

26. A method of testing a well in accordance with claim 25 wherein an equalizing valve is included in said probe assembly.

27. A method of testing a well in accordance with claim 26 wherein said probe assembly is supported on a wireline and a force to operate a valve for intermittently flowing well fluids is applied to said probe assembly through said wireline.

* * * * *